US006839526B2

(12) United States Patent
Shibata

(10) Patent No.: US 6,839,526 B2
(45) Date of Patent: Jan. 4, 2005

(54) METHOD AND APPARATUS FOR FORMING IMAGE

(75) Inventor: Kyoichi Shibata, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/279,114

(22) Filed: Oct. 24, 2002

(65) Prior Publication Data

US 2004/0126128 A1 Jul. 1, 2004

(51) Int. Cl.[7] ..... G03G 15/00; G03G 15/01
(52) U.S. Cl. ..... 399/82; 399/43; 399/302
(58) Field of Search ..... 399/82, 301, 302, 399/308, 16, 43, 38, 160; 358/1.12, 1.13, 1.16, 296, 404

(56) References Cited

U.S. PATENT DOCUMENTS 5,758,251 A * 5/1998 Takahashi et al. ..... 399/395
6,122,461 A * 9/2000 Shinohara ..... 399/43
6,192,208 B1 2/2001 Maekawa
6,204,927 B1 3/2001 Saito et al.
6,253,039 B1 * 6/2001 Nakano et al. ..... 399/302 X
6,332,066 B1 * 12/2001 Yanagawa ..... 399/302
6,370,343 B1 * 4/2002 Watanabe ..... 399/302 X

FOREIGN PATENT DOCUMENTS

| | | | |
|---|---|---|---|
| JP | 10083104 | | 3/1998 |
| JP | 10-115966 | * | 5/1998 |
| JP | 10-232532 | * | 9/1998 |
| JP | 2000-066475 | * | 3/2000 |
| JP | 2000172129 | | 6/2000 |

* cited by examiner

*Primary Examiner*—Sophia S. Chen
(74) *Attorney, Agent, or Firm*—Foley & Lardner LLP

(57) ABSTRACT

In an image forming apparatus, the position of latent image forming on a photosensitive drum is changed to thereby dynamically change the position of image forming on an intermediate transfer medium in accordance with printing conditions, thereby enabling an image to be transferred onto each sheet of a printing medium while the intermediate transfer medium is being rotated at a predetermined speed even if the image forming position is changed. The printing conditions are determined by, for example, setting for at least one of double-sided printing, offset paper discharge using a finisher, a post process related to stapling, use/nonuse of an electronic sorter, and image processing.

6 Claims, 7 Drawing Sheets

METHOD AND APPARATUS FOR FORMING IMAGE

BACKGROUND OF THE INVENTION

The present invention relates to an image forming apparatus and method.

In general page printers, a latent image formed on a photosensitive drum and developed thereon is directly transferred onto a printing medium. On the other hand, in page printers using an intermediate transfer medium, an image is once transferred onto an intermediate transfer medium such as a belt, and is then transferred onto a conveyed printing medium. This mechanism is advantageous in that it is not necessary to provide a plurality of process units in a color printing apparatus.

In general, in color printing, a plurality of colors, such as CMYK, are used.

In the case of a plurality of colors, to print them onto a printing medium using one path is the simplest control method.

However, this method requires process units corresponding to the respective colors, resulting in an increase in the size of the apparatus and in cost.

On the other hand, in intermediate-transfer-type printing apparatuses, when color printing is executed, each of the colors is transferred onto the intermediate transfer medium whenever the intermediate transfer medium rotates through one rotation, and all the colors are simultaneously transferred therefrom onto a printing medium. This method does not require a process unit corresponding to each color, and hence is widely employed in, in particular, a small-sized intermediate/low-speed machine.

If the intermediate-transfer-type printing apparatus is compatible with A3-size, the circumference of the intermediate transfer medium is equal to or greater than the length of A3-size sheets. When A4-size printing is executed using this printing apparatus, a widely known method is employed, in which image data corresponding to two pages is formed on the intermediate transfer medium and is then simultaneously transferred onto a printing medium such as paper.

This method is advantageous in enhancing the throughput since two sheets of the printing medium are always continuously conveyed as if they are coupled.

In the meantime, when double-sided printing is executed using, for example, a stackless ADU (Auto Duplex Unit), paper sheets must be conveyed with an interval that enables each sheet to be reversed, since each sheet is reversed after printing is executed on one side. Also in the case of executing a post-process such as offset paper discharge, stapling, etc., using a finisher, a paper interval that enables the post-process is needed. Thus, appropriate paper intervals are necessary for these processes.

On the other hand, in the above-described conventional intermediate-transfer-type printing apparatus, when printing is executed using the intermediate transfer medium, image forming is executed in accordance with the rotation of the intermediate transfer medium, therefore conveyance of the printing medium must also be adjusted to the rotation.

For example, when image forming of two pages is executed, the interval between printing medium sheets of pages 1 and 2 is identical to that of images formed on the intermediate transfer medium.

Thus, in the prior art, when the above-mentioned process is executed, a sheet interval more than required is secured, at the sacrifice of the throughput, by printing only a one-page image on the intermediate transfer medium even if the image is an A4-size image, or by temporarily stopping the intermediate transfer medium or making it run idle.

BRIEF SUMMARY OF THE INVENTION

It is an object of the invention to adjust the interval between paper sheets by changing the image forming position on an intermediate transfer medium in accordance with printing conditions, thereby enhancing the throughput and facilitating double-sided printing, stapling, etc.

To satisfy the aim, according to a first aspect of the invention, there is provided an image forming apparatus comprising: a conveyance section which conveys sheets of a printing medium; an image forming section including a photosensitive drum which forms a latent image of an image, and an intermediate transfer medium which holds the image, the image being transferred from the intermediate transfer medium onto each sheet of the printing medium; and a control section which executes control to change a latent image forming position on the photosensitive drum in order to dynamically change an image forming position on the intermediate transfer medium in accordance with printing conditions, thereby enabling the image to be transferred onto the each sheet of the printing medium while the intermediate transfer medium is being rotated at a predetermined speed even if the image forming position is changed.

According to a second aspect of the invention, there is provided an image forming method comprising: conveying sheets of a printing medium; transferring an image from an intermediate transfer medium onto each sheet of the printing medium, the intermediate transfer medium being included in an image forming section which also includes a photosensitive drum which forms a latent image of the image; and executing control, using a control section, to change a latent image forming position on the photosensitive drum in order to dynamically change an image forming position on the intermediate transfer medium in accordance with printing conditions, thereby enabling the image to be transferred onto the each sheet of the printing medium while the intermediate transfer medium is being rotated at a predetermined speed even if the image forming position is changed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of the invention will be described with reference to the accompanying drawings.

Figure 1:
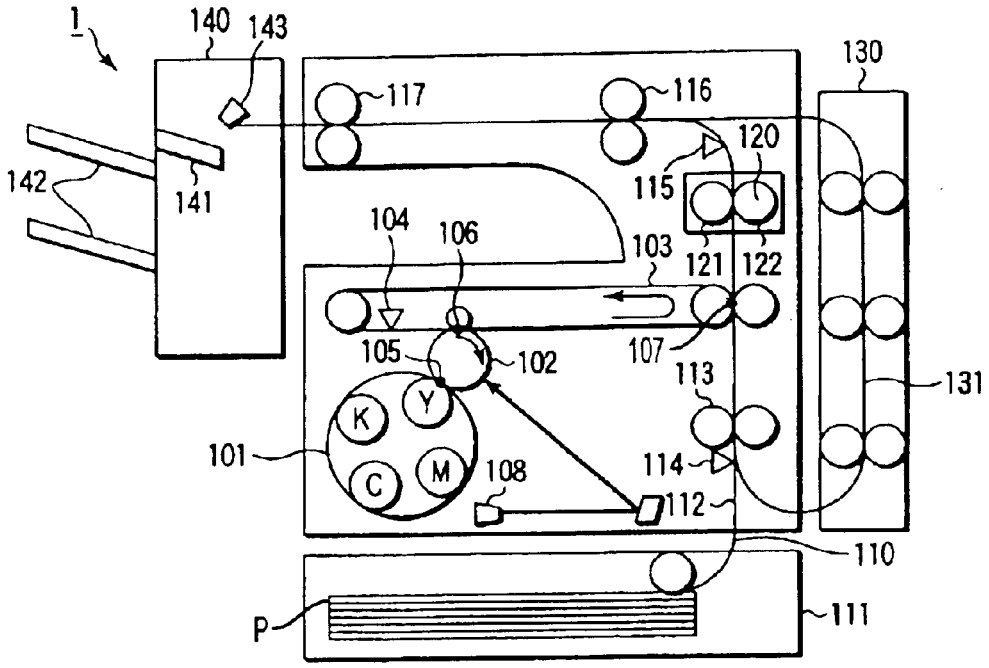
FIG. 1 is a schematic view illustrating an image forming apparatus according to an embodiment of the invention.

FIG. 1 is a schematic view illustrating an image forming apparatus according to an embodiment of the invention, which employs an intermediate transfer method.

As seen from FIG. 1, a printer apparatus 1, a process unit 100 as an image forming section at least comprises a revolver-type toner cartridge 101, photosensitive drum 102, intermediate transfer belt 103, and marker sensor 104, exposure unit 108, etc. The process unit 100 forms an output image as a visible image corresponding to image data, which is supplied from a data feed section such as a host computer.

In this embodiment, the exposure unit 108 is, for example, a laser beam exposure unit that can continuously emit a laser beam onto the photosensitive drum 102 in the longitudinal direction.

It is a matter of course that the process unit 100 may employ a thermal transfer method, ink jet method, etc., as well as the electronic photography method.

The revolver-type toner cartridge 101 contains four color toners, i.e., Yellow (Y), Magenta (M), Cyan (C) and Black (K). When a monochrome image is printed, only K is used. Markers for positioning are provided on five portions of the intermediate transfer belt 103. In printing of a monochrome image, the image once transferred is directly transferred. Accordingly, positioning using the markers is not necessary.

A paper conveyance unit 110 as a conveyance section comprises a paper cassette 111 that can contain an arbitrary number of paper sheets as a medium for holding an output image, conveyance path 112 for guiding each paper sheet between the paper cassette 111 and process unit 100 and between the process unit 100 and a fixing unit 120, and resist controller 113 for adjusting skew of the paper sheets conveyed on the conveyance path 112.

The alignment of the image formed on the intermediate transfer belt 103 with the printing medium is adjusted by controlling the start of the formation of a latent image on the photosensitive drum 102, and the restart of the printing medium from the resist roller 113.

The path 112 includes a plurality of sensors capable of detecting jamming on the path 112 of the printing medium conveyed thereon, i.e., an aligning sensor 114, fixing/double-side sensor 115, etc.

The fixing unit 120 comprises a first roller 121 that can be heated to a predetermined temperature, and second roller 122 capable of providing a predetermined pressure to the first roller 121. In the fixing unit 120, the toner electrostatically attached to each paper sheet is melted and pressurized while each paper sheet is being passed between the rollers, whereby the toner is fixed on it.

In many cases, a heater (not shown) is integrally provided on the first roller 121 for increasing the temperature of the first roller 121 to the predetermined temperature.

A double-sided-process unit 130 includes a path 131 similar to that of the conveyance system 110, and a plurality of rollers or belts (which are not described in detail), or a combination of them, and a plurality of sensors capable of detecting jamming on the path 131 of the printing medium conveyed thereon. The sensors are, for example, an approach sensor for detecting whether a paper sheet is conveyed onto the path 131, and a discharge sensor for detecting whether a paper sheet can be conveyed toward the conveyance system 110.

In the printer apparatus 1 constructed as above, firstly, a laser beam is emitted from the exposure unit 108 to the photosensitive drum 102, thereby forming a latent image. The photosensitive drum 102 continues to rotate, whereby toner is attached to the image at a development position 105 to develop it. The photosensitive drum 102 further continues to rotate to thereby transfer the toner at a primary transfer position 106 onto the intermediate transfer belt 103 as an intermediate transfer medium (primary transfer). The intermediate transfer belt 103 continues to rotate, whereby the image reaches a secondary transfer position 107.

On the other hand, while a process is being executed at the process unit 100 side, the printing medium is fed from the paper cassette 111. The resist roller 113 adjusts the skew of the medium that occurs during conveyance, and temporarily stops and waits. The roller 113 restarts the sheet conveyance so that the image formed on the intermediate transfer belt 103 can be superposed upon the printing medium at the secondary transfer position 107, thereby executing secondary transfer.

The printing medium is conveyed through the paper conveyance unit 110.

The printing medium sheet with a toner image electrostatically attached thereto is guided between the first and second rollers 121 and 122 of the fixing unit 120, where the toner is melted by the heat from the first roller 121 and fixed onto the sheet by the pressure applied from the second roller 122. This sheet is then guided and discharged into an intermediate tray 141 or discharge tray 142 by conveyance rollers 116 and 117.

When double-sided output is executed, the paper sheet with an output image fixed thereon is guided to the double-sided-process unit 130 by reversing the direction of rotation of at least one of the first and second rollers 121 and 122 of the fixing unit 120. The paper sheet P is reversed so that the second surface of the sheet can be brought into contact with the intermediate transfer belt 103 of the process unit 100 at the secondary transfer position 107. The sheet is guided in a topsy-turvy state to the resist roller 113 of the sheet conveyance unit 110. After that, the same process as described above is executed, and the resultant sheet is discharged.

In the printer apparatus 1, the sheet conveyance speed to the resist roller 113 is set higher than that of the process executed after restart. This enables the transfer during the process to be executed on the safe side even if the printing medium is stopped at the resist roller 113.

Further, in the printer apparatus 1, the change of the position (primary transfer position) of the image on the intermediate transfer belt 103 as the intermediate transfer medium is realized by changing the position of the latent image. This enables the photosensitive drum 102 and intermediate transfer belt 103 to be continuously rotated at a predetermined speed during printing, whereby the positional accuracy of secondary transfer to the printing medium can be maintained.

Figure 2:
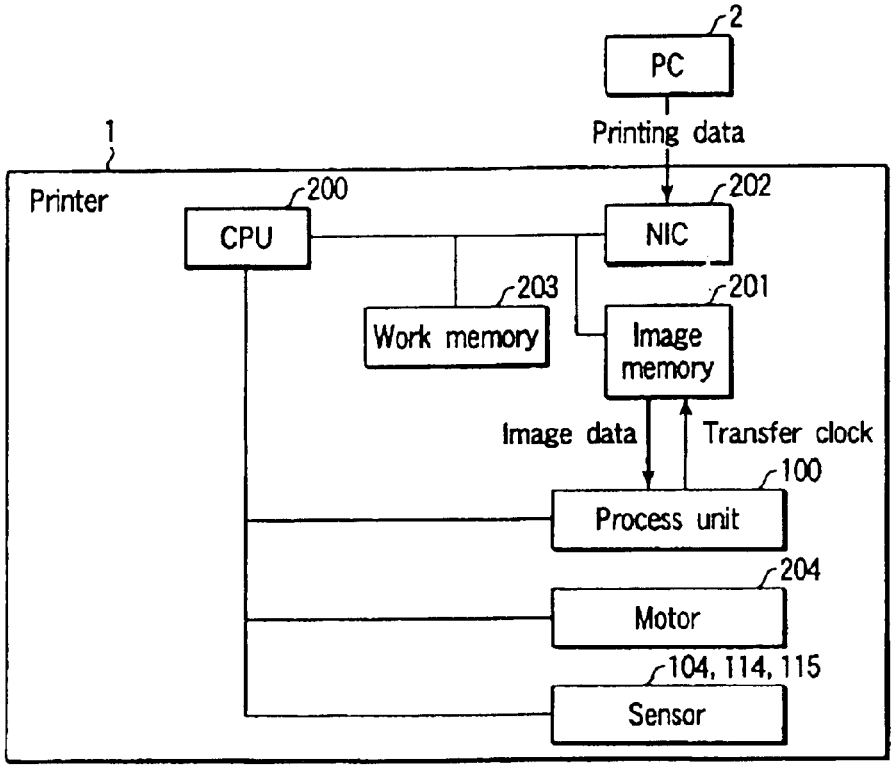
FIG. 2 is a schematic block diagram useful in explaining an example of a flow of image data in the image forming apparatus of the embodiment of the invention.

FIG. 2 is a schematic diagram useful in explaining an example of a control system that can be employed in a printer apparatus as an example of the image forming apparatus shown in FIG. 1.

As shown in FIG. 2, the printer apparatus 1 includes a CPU 200 for controlling the fetch-in process and output process of image data used for the process unit 100 to output an image.

The CPU 200 is connected to an image memory 201 for storing, in units of pages, image data corresponding to an image output from the process unit 100, and a network interface 202 for enabling image data to be input to the image memory 201 from an external device represented by, for example, a personal computer.

The network interface 202 is also called a "network interface card (NIC)", since it is in the form of a card in many cases.

The CPU 200 is also connected to a page management device, i.e., a work memory 203, capable of changing the output order of the data items stored in the image memory 201, the data items being output to the process unit 100. The work memory 203 holds, as parallel data, image data of one page output from the image memory 201 via the process unit 100.

The CPU 200 is further connected to various elements (not shown) that define the process unit 100, and drivers necessary to drive the elements.

In addition to the above, the CPU 200 is connected, via respective motor drivers (not shown), to a feed motor for picking each paper sheet from the paper cassette 111, conveyance system motor for rotating the rollers provided in the paper conveyance unit 110, main motor for rotating the photosensitive drum 102 at a predetermined speed, fixing motor for rotating the roller 122 of the fixing unit 120, and a plurality of motors (denoted by reference numeral 204 in FIG. 2) such as a double-sided conveyance motor for rotating an arbitrary roller or belt on the path 131 of the double-sided-process unit 130.

The CPU 200 is further connected, via respective input circuits (not shown), to various sensors 104, 114 and 115 provided at predetermined positions in the conveyance system 110 and double-sided-process unit 130. Some sensors may generate an output obtained by converting a current value into a voltage value, and hence require no input circuit.

A detailed description will now be given of the printer apparatus as an example of the image forming apparatus according to an embodiment of the invention.

Referring to the timing chart of FIG. 3, the operation of printing an A3-size monochrome image on one side of an A3-size paper sheet will be described.

As aforementioned, the revolver-type toner cartridge 101 in the printer apparatus 1 contains toners of four colors, i.e., Yellow (Y), Magenta (M), Cyan (C) and Black (K).

In monochrome printing, only color K is used.

Although the intermediate transfer belt 103 has positioning markers at five positions, positioning using the markers is not necessary in monochrome printing, since the image obtained by primary transfer is directly transferred to the printing medium. Naturally, the distance from the detection position of a certain marker to the same detection position reached via the detection positions of the other three markers corresponds to the circumference of the intermediate transfer belt 103.

In the printer apparatus 1, firstly, a laser beam is emitted onto the photosensitive drum 102, thereby forming a latent image thereon. The photosensitive drum 102 continues to rotate, whereby toner is attached to the image at the development position 105 to develop it. The photosensitive drum 102 further continues to rotate to thereby transfer the toner at the primary transfer position 106 onto the intermediate transfer belt 103. The intermediate transfer belt 103 continues to rotate, whereby the image reaches a secondary transfer position 107. On the other hand, while the process is being executed, the printing medium is fed from the paper cassette 111. The resist roller 113 adjusts the skew of the medium that occurs during conveyance, and temporarily stops and waits. The roller 113 restarts the sheet conveyance so that the image formed on the intermediate transfer belt 103 can be superposed upon the printing medium at the secondary transfer position 107, thereby executing secondary transfer.

In monochrome image printing, the alignment of the image formed on the intermediate transfer belt 103 and the printing medium is adjusted by adjusting the start of the formation of a latent image on the photosensitive drum 102, to the restart of the printing medium from the resist roller 113.

Figure 4:
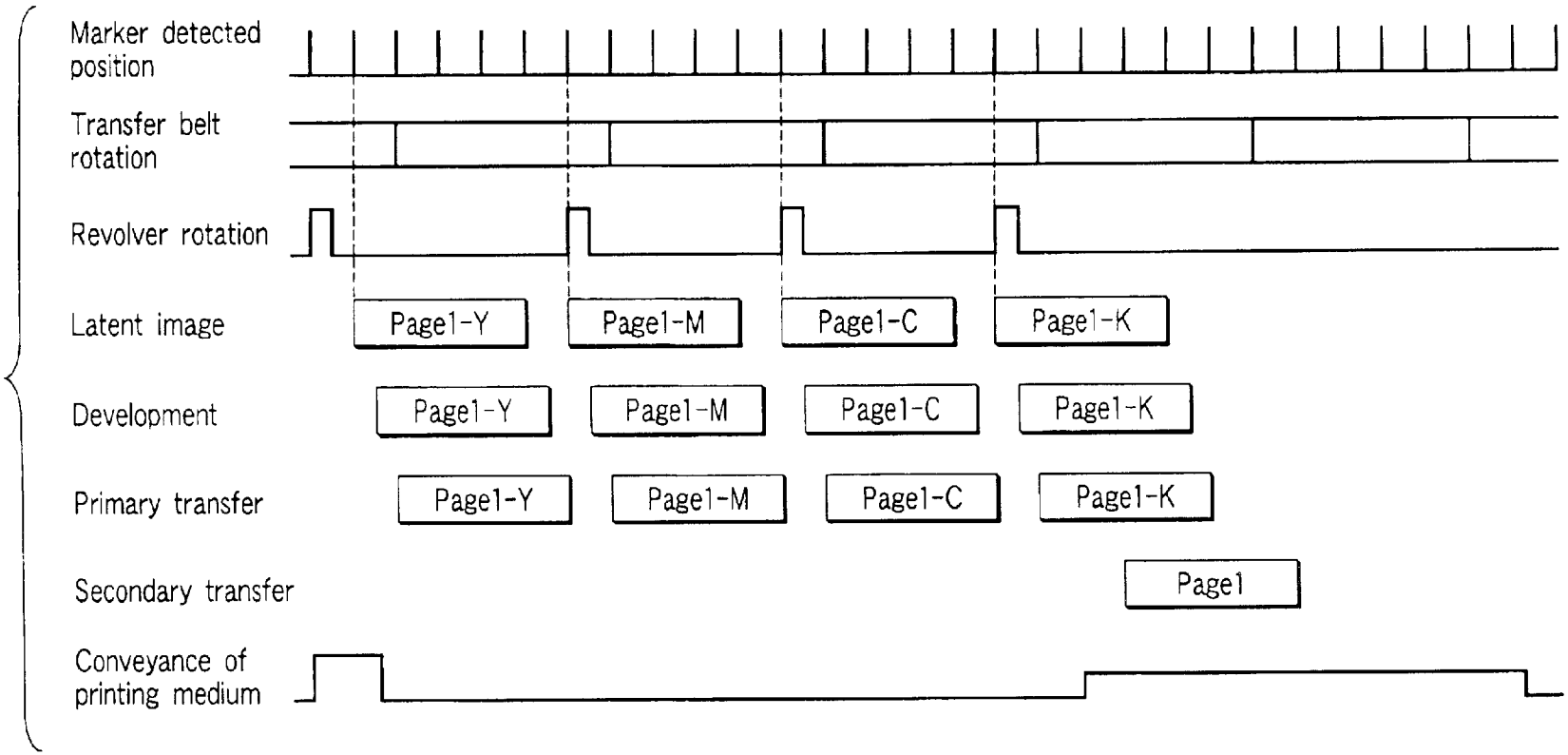
FIG. 4 is a timing chart illustrating the operations, related to one-side one-page printing of an A3-size color image, executed by the image forming apparatus of the embodiment.

Referring to the timing chart of FIG. 4, the operation of printing an A3-size color image on one side of an A3-size paper sheet will be described.

In color printing, it is necessary to superpose four colors upon each other on the intermediate transfer belt 103. For this positioning, the markers are used.

Specifically, to execute color printing, firstly, the intermediate transfer belt 103 is rotated to detect the markers by the marker sensor 104. Since the markers are situated at five positions, control can be executed at optimal timing without waiting for one rotation. Upon detection of a marker by the marker sensor 104, latent image forming, development and primary transfer are executed for a Y plane with reference to the detected marker.

Subsequently, similar processing is executed for an M plane by rotating the revolver-type toner cartridge 101. This is repeated for C and K planes, thereby forming color images of four colors on the intermediate transfer belt 103. Since there is a physical distance between the latent image position and primary transfer position, the processes for the respective color planes temporally slightly overlap each other. The intermediate transfer belt 103 continues to rotate, whereby the color image formed thereon reaches the second transfer position 107. On the other hand, the printing medium is fed from the paper cassette 111 while the process is being executed. The resist roller 113 adjusts the skew of the medium that occurs during conveyance, and temporarily stops and waits. The roller 113 restarts the sheet conveyance so that the image formed on the intermediate transfer belt 103 can be superposed upon the printing medium at the secondary transfer position 107, thereby executing secondary transfer.

Figure 5:
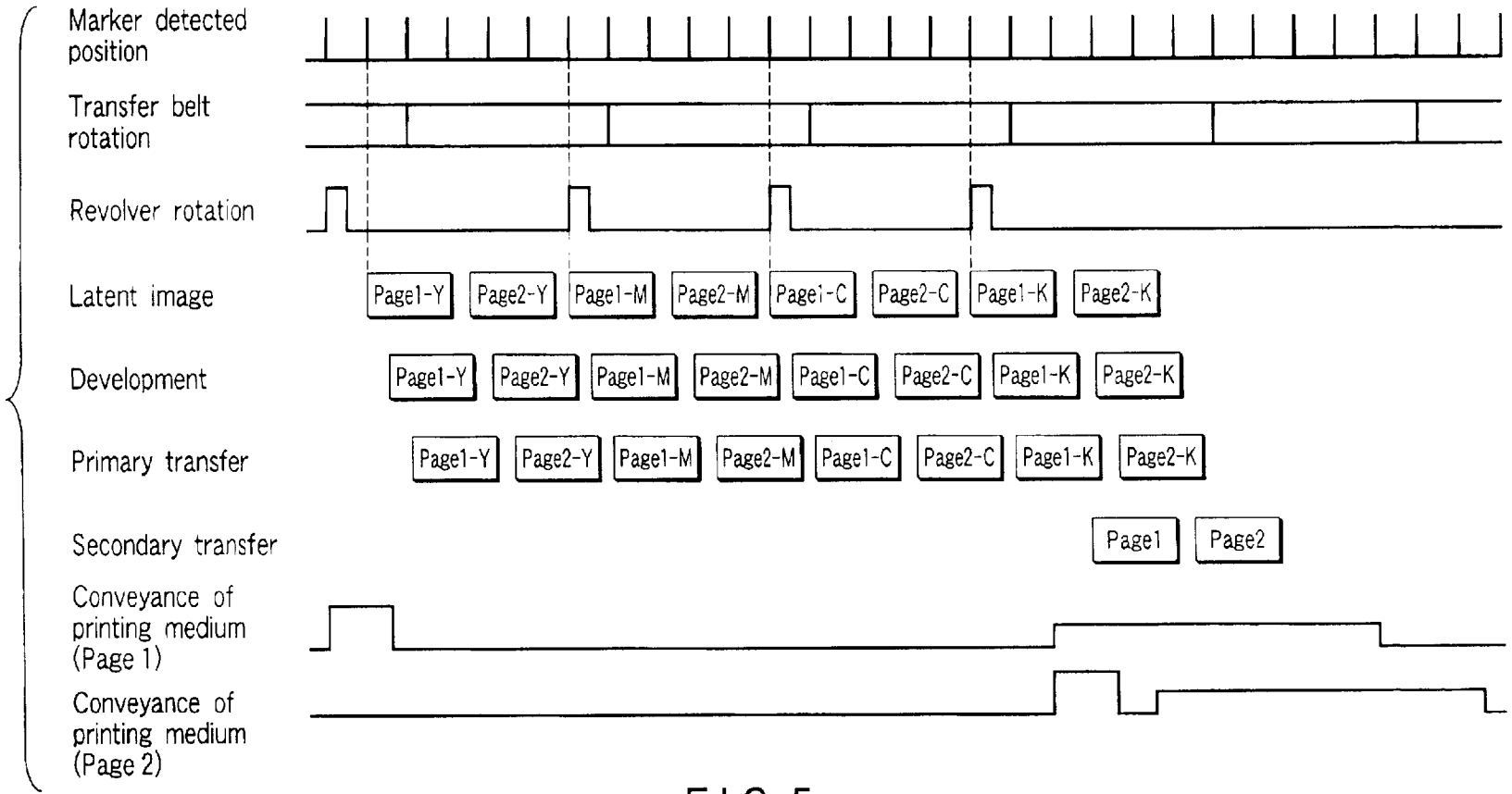
FIG. 5 is a timing chart illustrating the operations, related to one-side two-page printing of A4-size color images, executed by the image forming apparatus of the embodiment.

Referring to the timing chart of FIG. 5, the operation of continuously printing two A4-size color images on one side of each of two A4-size paper sheets will be described.

In this case, since the printer apparatus 1 is compatible with A3-size, printing data corresponding to two pages of A4-size is placed on the intermediate transfer belt 103 and is simultaneously transferred onto two pages of the printing medium to thereby enhance the throughput.

Figure 3:
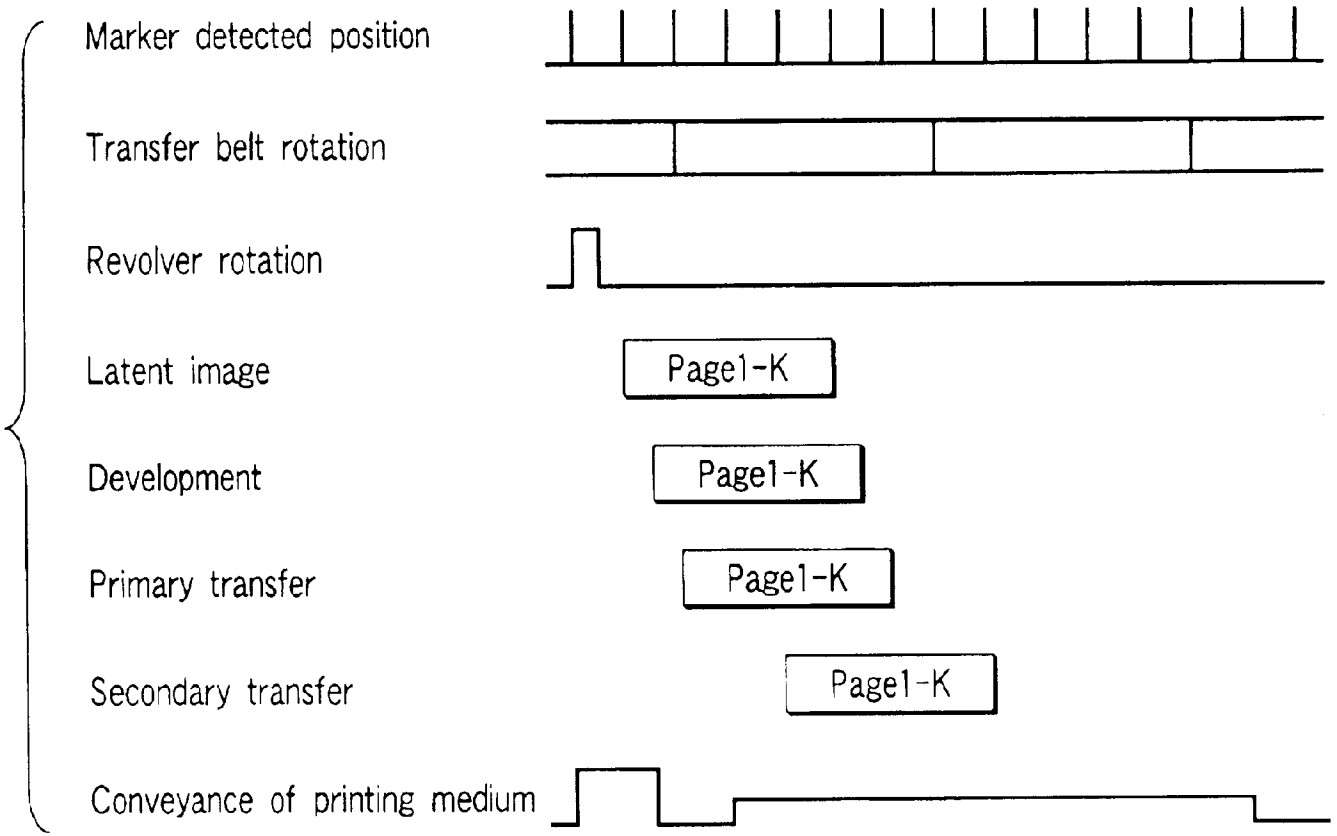
FIG. 3 is a timing chart illustrating the operations, related to one-side one-page printing of an A3-size monochrome image, executed by the image forming apparatus of the embodiment.

The basic operations are similar to those illustrating in FIG. 3. Firstly, the intermediate transfer belt 103 is rotated to detect a marker by the marker sensor 104. Upon detection of a marker by the marker sensor 104, latent image forming, development and primary transfer corresponding to two pages are continuously executed for a Y plane with reference to the detected marker.

Subsequently, similar two-page processing is executed for an M plane by rotating the revolver-type toner cartridge 101. This is repeated for C and K planes, thereby forming color images of four colors on the intermediate transfer belt 103.

Since there is a physical distance between the latent image position and primary transfer position, the processes for the respective color planes temporally slightly overlap each other.

The intermediate transfer belt 103 continues to rotate, whereby the color image formed thereon reaches the second transfer position 107. On the other hand, the printing medium is fed from the paper cassette 111 while the process is being executed. The resist roller 113 adjusts the skew of the medium that occurs during conveyance, and temporarily stops and waits. The roller 113 restarts the sheet conveyance so that the image formed on the intermediate transfer belt 103 can be superposed upon the printing medium at the secondary transfer position 107, thereby executing secondary transfer. In this case, two sheets of the printing medium are always continuously transferred and conveyed as if they are coupled.

The above-described operations are presuppositions. The image forming apparatus according to the embodiment, which uses an intermediate transfer medium, is characterized in that the image data forming position on the intermediate transfer medium is dynamically changed in accordance with the printing conditions.

Further, the image forming apparatus using an intermediate transfer medium is characterized in that the image data forming position on the intermediate transfer medium is changed between monochrome printing and color printing. The characterizing operation will now be described in detail.

Figure 6:
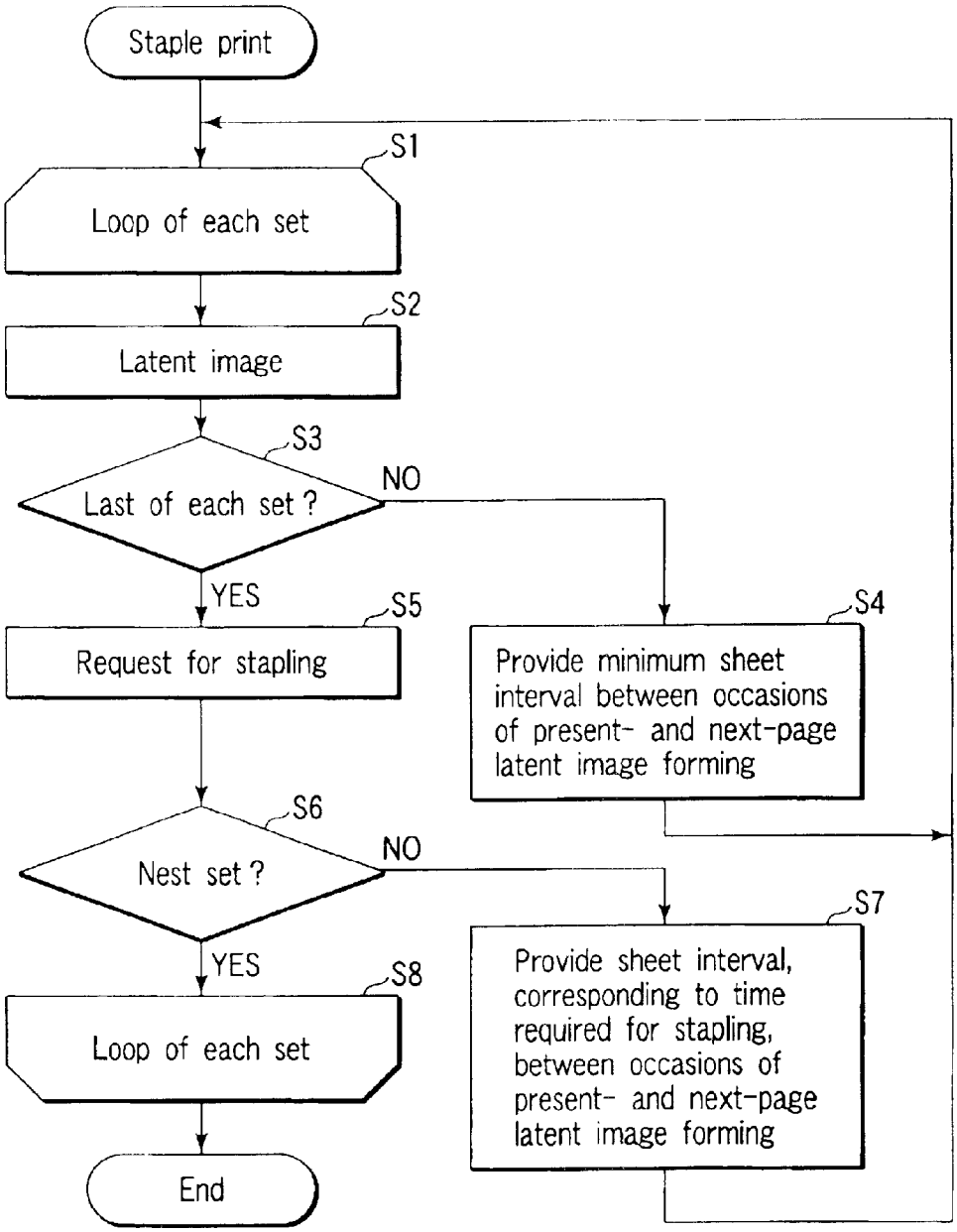
FIG. 6 is a flowchart illustrating the operations, related to two-page printing and stapling of A4-size monochrome images, executed by the image forming apparatus of the embodiment.
Figure 7:
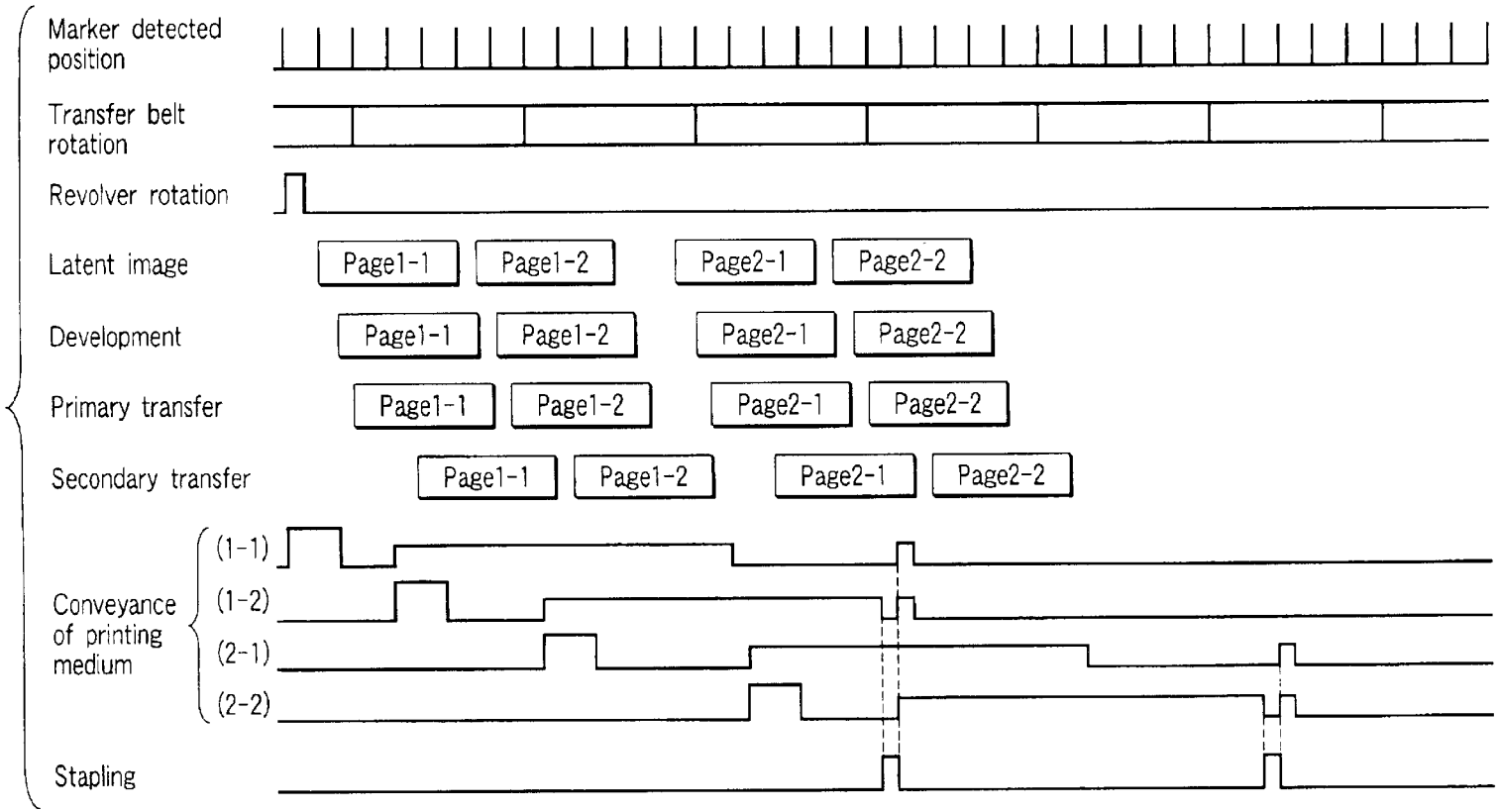
FIG. 7 is a timing chart illustrating the operations, related to two-page printing and stapling of A4-size monochrome images, executed by the image forming apparatus of the embodiment.

Referring to FIGS. 6 and 7, the characterizing operation of the image forming apparatus according to the embodiment will be described. A description will be given of, for example, the case of printing two sets of A4-size monochrome images, each set being two pages, and stapling the two pages of each set together.

Printout data items corresponding to printout images are supplied from an external device, such as a PC2, to the printer apparatus 1, in the ascending order of page number. The printout data input to the NIC 202 is edited on the basis of a predetermined rule or limitation, and is stored as image data in the image memory 201. When image data corresponding to two pages is accumulated in the image memory 201, the CPU 200 generates an instruction to print the data, whereby the following printing operation is started.

The image data stored in the image memory 201 is output to the exposure unit 108 at a predetermined point in time, latent images corresponding to two pages are formed on the photosensitive drum 102, and then development and primary transfer are continuously executed. The interval of present- and next-page latent image forming is set to a value corresponding to the minimum sheet interval. In monochrome printing, in light of the fact that adjustment according to the rotation of the intermediate transfer belt 103 is not needed, the interval of image forming on the intermediate transfer belt 103 and that of printing medium sheet conveyance are reduced during continuous printing for each data set in order to enhance the throughput.

While the process is being executed, two printing medium sheets are continuously fed from the paper cassette 111 with a predetermined interval. The resist roller 113 adjusts the skew of the medium sheets that occurs during conveyance, and temporarily stops and waits. The roller 113 restarts the sheet conveyance so that the images formed on the intermediate transfer belt 103 can be superposed upon the respective printing medium sheets at the secondary transfer position 107, thereby continuously executing secondary transfer (steps S1–S4).

Thus, when the two printing medium sheets have reached a finisher 140, they are stapled by a stapler 143 in synchronism with the ON state of a staple signal, and are discharged together into an intermediate tray 141 and then a discharge tray 142 (steps S5–S8).

The above-described process is executed on the first set, and the same process is executed on the second set. When there are the second set, et seq. as in this case, the interval corresponding to the stapling process is added to the interval of present- and next-page latent image forming. In other words, since a certain time period is required, between adjacent sets, for the stapler 143 of the finisher 140 to execute stapling, the interval of image forming on the intermediate transfer belt 103 and that of printing medium conveyance are increased by a necessary amount. As a result, the reduction of the throughput is minimized while the stapling process is executed.

In the embodiment, it is one object to appropriately adjust the sheet interval in accordance with the printing conditions. Therefore, the position of image forming on the intermediate transfer belt 103 can be adjusted not only to increase the printing medium sheet interval but also to reduce it. The greater the printing medium sheet interval is reduced, the more the throughput is increased.

Figure 8:
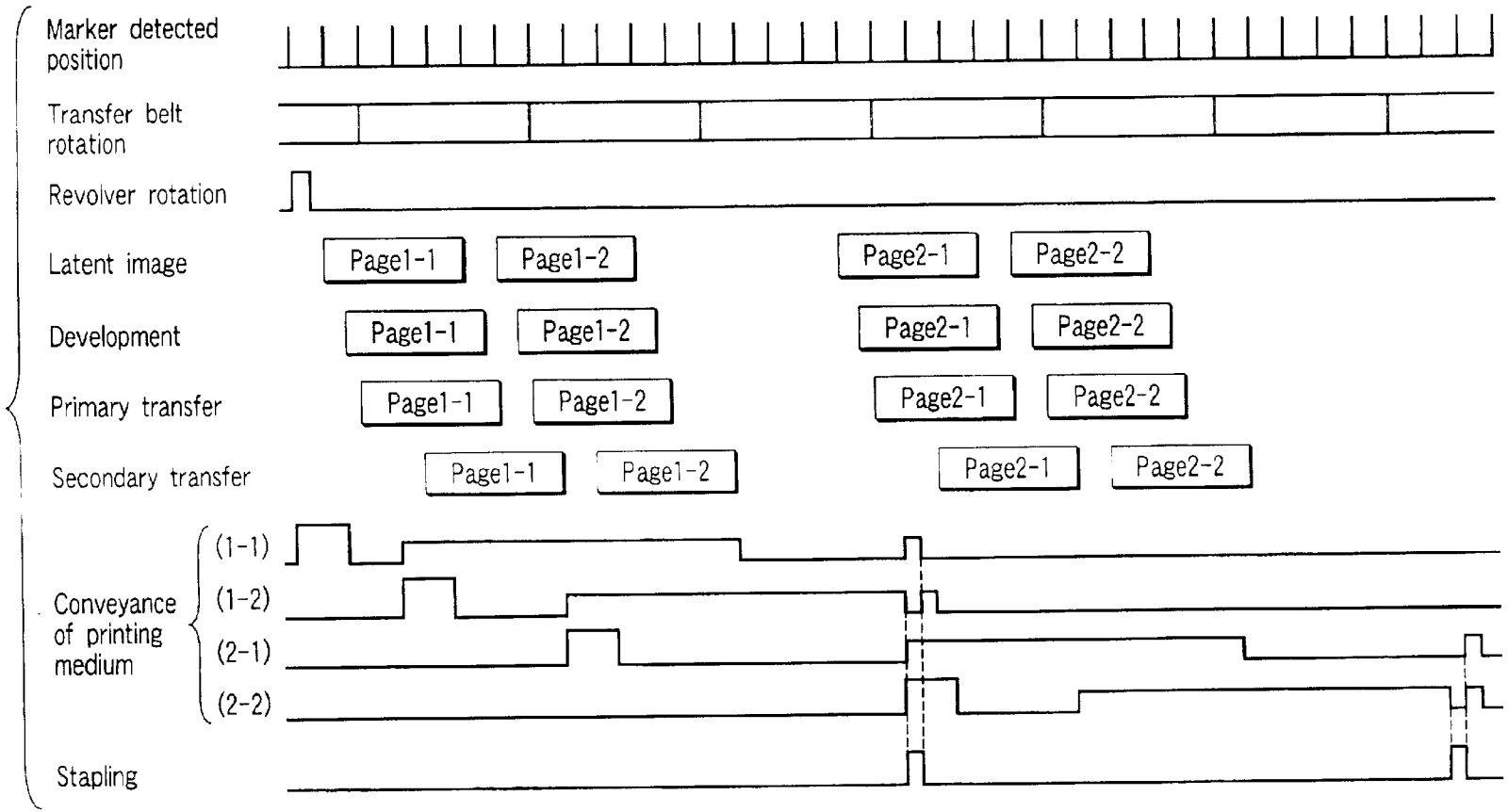
FIG. 8 is a timing chart illustrating the operations, related to two-page printing and stapling of A4-size monochrome images, executed where the contrivances as in the present invention are not employed.

FIG. 8 shows an example in which the above-described contrivance is not made on the interval of present- and next-page latent image forming for each set, or on the interval of present- and next-page latent image forming between adjacent sets. If the above-described process of the image forming apparatus according to the embodiment of the invention is compared with the case of FIG. 8, it is evident that, in the former, both the intervals are reduced to the necessary minimum ones and hence the throughput is enhanced.

Although in the above embodiment of the invention, printing of monochrome images has been described as an example, the invention is also applicable to mono-color printing or multi-color printing. For mono-color printing, the same control as in monochrome printing can be executed. On the other hand, in multi-color printing, the transfer position can be shifted within the range of one rotation of the intermediate transfer medium, i.e., can be shifted to the position on the intermediate transfer medium corresponding to an end of each page.

Even in a printing apparatus using an intermediate transfer medium, the embodiment of the invention enables the apparatus to adjust the printing medium sheet interval during conveyance, thereby enhancing the throughput and facilitating double-sided printing or stapling, etc.

For positioning control for transferring image data onto the intermediate transfer belt, conventional methods, such as detection of a home position, control of the number of pulses generated by an encoder or stepping motor, time control using a timer, etc., can be used.

For example, when double-sided printing of monochrome images is executed, if image data items are transferred onto the intermediate transfer medium with an appropriate interval that enables a printing medium sheet to be reversed, irrespective of the rotation of the intermediate transfer medium, the printing medium sheet can be conveyed in the same manner as in the conventional monochrome printing that uses no intermediate transfer medium.

Furthermore, when printing is executed on small paper sheets of, for example, A6 size, the image interval on the intermediate transfer medium is reduced, and printing is executed on two or more sheets while the intermediate transfer medium is executing one rotation. As a result, the throughput is enhanced.

The above-described embodiment is applicable to devices, such as a finisher, stapler, electronic sorter, etc., in which an interval must be provided between printing medium sheets.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a conveyance section which conveys sheets of a printing medium;

an image forming section including a photosensitive drum which forms a latent image of an image, and an intermediate transfer medium which holds the image, the image being transferred from the intermediate transfer medium onto each sheet of the printing medium; and a control section which executes control to change a latent image forming position on the photosensitive drum in order to dynamically change an image forming position on the intermediate transfer medium in accordance with printing conditions, thereby enabling the image to be transferred onto said each sheet of the printing medium while the intermediate transfer medium is being rotated at a predetermined speed even if the image forming position is changed, wherein the control section executes control to make the image forming position on the intermediate transfer medium different between monochrome image printing and color image printing.

2. An image forming apparatus comprising:

a conveyance section which conveys sheets of a printing medium;

an image forming section including a photosensitive drum which forms a latent image of an image, and an intermediate transfer medium which holds the image, the image being transferred from the intermediate transfer medium onto each sheet of the printing medium; and a control section which executes control to change a latent image forming position on the photosensitive drum in order to dynamically change an image forming position on the intermediate transfer medium in accordance with printing conditions, thereby enabling the image to be transferred onto said each sheet of the printing medium while the intermediate transfer medium is being rotated at a predetermined speed even if the image forming position is changed, wherein when printing is executed on a plurality of sets of sheets, the control section executes control, during continuous printing of each of the sets, to reduce an image forming interval on the intermediate transfer medium and a printing medium sheet interval.

3. An image forming apparatus comprising:

a conveyance section which conveys sheets of a printing medium;

an image forming section including a photosensitive drum which forms a latent image of an image, and an intermediate transfer medium which holds the image, the image being transferred from the intermediate transfer medium onto each sheet of the printing medium; and a control section which executes control to change a latent image forming position on the photosensitive drum in order to dynamically change an image forming position on the intermediate transfer medium in accordance with printing conditions, thereby enabling the image to be transferred onto said each sheet of the printing medium while the intermediate transfer medium is being rotated at a predetermined speed even if the image forming position is changed, wherein when printing and stapling are executed on a plurality of sets of sheets, the control section executes control, between each pair of adjacent sets, to set an image forming interval on the intermediate transfer medium and a printing medium sheet interval to a value corresponding to a time period required for stapling.

4. An image forming method comprising:

conveying sheets of a printing medium;

transferring an image from an intermediate transfer medium onto each sheet of the printing medium, the intermediate transfer medium being included in an image forming section which also includes a photosensitive drum which forms a latent image of the image; and executing control, using a control section, to change a latent image forming position on the photosensitive drum in order to dynamically change an image forming position on the intermediate transfer medium in accordance with printing conditions, thereby enabling the image to be transferred onto said each sheet of the printing medium while the intermediate transfer medium is being rotated at a predetermined speed even if the image forming position is changed, wherein control is executed by the control section to make the image forming position on the intermediate transfer medium different between monochrome image printing and color image printing.

5. An image forming method comprising:

conveying sheets of a printing medium;

transferring an image from an intermediate transfer medium onto each sheet of the printing medium, the intermediate transfer medium being included in an image forming section which also includes a photosensitive drum which forms a latent image of the image; and executing control, using a control section, to change a latent image forming position on the photosensitive drum in order to dynamically change an image forming position on the intermediate transfer medium in accordance with printing conditions, thereby enabling the image to be transferred onto said each sheet of the printing medium while the intermediate transfer medium is being rotated at a predetermined speed even if the image forming position is changed, wherein when printing is executed on a plurality of sets of sheets, control is executed by the control section during continuous printing of each of the sets, to reduce an image forming interval on the intermediate transfer medium and a printing medium sheet interval.

6. An image forming method comprising:

conveying sheets of a printing medium;

transferring an image from an intermediate transfer medium onto each sheet of the printing medium, the intermediate transfer medium being included in an image forming section which also includes a photosensitive drum which forms a latent image of the image; and executing control, using a control section, to change a latent image forming position on the photosensitive drum in order to dynamically change an image forming position on the intermediate transfer medium in accordance with printing conditions, thereby enabling the image to be transferred onto said each sheet of the printing medium while the intermediate transfer medium is being rotated at a predetermined speed even if the image forming position is changed, wherein when printing and stapling are executed on a plurality of sets of sheets, control is executed by the control section between each pair of adjacent sets, to set an image forming interval on the intermediate transfer medium and a printing medium sheet interval to a value corresponding to a time period required for stapling.

* * * * *